US006856248B2

(12) United States Patent
Wang

(10) Patent No.: US 6,856,248 B2
(45) **Date of Patent: *Feb. 15, 2005**

(54) ALARM SYSTEM WITH DIGITAL VERIFICATION CONTROL

(76) Inventor: Randall Wang, 4978 Santa Anita Ave., Temple City, CA (US) 91780

( * ) Notice: Subject to any disclaimer, the term of this patent is extended or adjusted under 35 U.S.C. 154(b) by 0 days.

This patent is subject to a terminal disclaimer.

(21) Appl. No.: 10/392,791

(22) Filed: Mar. 21, 2003

(65) Prior Publication Data

US 2004/0183666 A1 Sep. 23, 2004

(51) Int. Cl.[7] ..... G08B 13/00

(52) U.S. Cl. ..... 340/541; 340/506; 340/507; 340/565; 340/527

(58) Field of Search ..... 340/506, 507, 340/541, 565, 527, 526, 529, 511, 522, 521, 309.16, 3.1

(56) References Cited

U.S. PATENT DOCUMENTS 5,532,680 A * 7/1996 Ousborne ..... 340/567
5,917,409 A * 6/1999 Wang ..... 340/506
6,137,407 A * 10/2000 Akagawa et al. ..... 340/552
6,157,299 A * 12/2000 Wang ..... 340/506

* cited by examiner

*Primary Examiner*—Anh V. La
(74) *Attorney, Agent, or Firm*—Raymond Y. Chan; David and Raymond

(57) ABSTRACT

A digital verification control, which is incorporated with an alarm system, includes a first timer device for presetting a single zone verification time in the control panel and second timer device for presetting a multiple zone verification time in the control panel. The single zone verification time is a single sensor time delay and arranged when one of the sensors detects at least two triggered signals in the respective detecting area within the single zone verification time, the local warning system is activated for producing a local warning signal. The multiple zone verification time, which is longer than the single zone verification time, is a multiple sensor time delay and arranged when the two sensors detect two triggered signals in the detecting areas respectively within the multiple zone verification time, the local warning system is activated for producing the local warning signal.

21 Claims, 5 Drawing Sheets

ALARM SYSTEM WITH DIGITAL VERIFICATION CONTROL

BACKGROUND OF THE PRESENT INVENTION

1. Field of Invention

The present invention relates to an alarm system, and more particularly to an alarm system with digital verification control, which can optimize both the false alarm reduction performance and the security protection performance.

2. Description of Related Arts

It is reported that less than 5% of the triggered alarms are caused by actual illegal events. More than 90% of the triggered alarms are false alarms caused by the detection as PIRs sensors. False alarms are the unsolved troubles to both the alarm companies and the police resources. Most alarm system owners have the unpleasant experience of being awaken in mid-night by the alarm company due to false alarms. Moreover, unaccountable waste of time and police force have been suffered by most of the policemen. Before the policemen arrive at the scene, no one knows whether it is a false alarm or an actual alarm. Therefore, the local police resource charges the alarm system owner a pretty high amount for a false alarm operation fee for each false alarm which causes a lot of complaints from users also. It creates a great burden to the limited police force in every city. In fact, millions of expenses have been wasted for the police resources in responding to the false alarms, that greatly degrades the efficiency and performance of the police. Accordingly, some of the police stations in this country consider abandoning such alarm response service. It will only be good news to all burglars. Therefore, how to effectively minimize the possibility of false alarm becomes an urgent topic to both the alarm users and the police resources.

The triggering of false alarms may frequently be caused by the insects such as the spiders and cockroach entering the covering area of a PIR sensor, the activity of animals such as birds, rats, and pets inside the PIR sensor covering area, and the vehicle headlight and weather thunder. It is because the detection ability of PIR sensor does not contain any verification capability like the human beings.

According to statistics, there are approximately 32.3 million to 35.5 million false alarm activations per year. The vast majority of alarm calls, between 94–98%, are false and approximately US$1.3 billion in annual costs are due to false alarms. In fact, reliability of alarms, if measured using false alarm rates, is generally between 2–6% only.

False alarms account for 10–25% of all calls to police. Each false alarm requires approximately 20 minutes of police time of usually two officers. Currently, between 21 and 24 million security alarm systems are in the US and approximately 18 million of which are monitored. One out of every seven U.S. businesses and one of every nine U.S. residences have alarms. Some industry estimates suggest that 1.5 million new alarms are installed annually. Solving the problem of false alarms would relieve 35,000 officers from providing what many sees as an essentially private service.

A process and system for reducing motion-type false alarm of security alarm system patented by the applicant of the present invention, U.S. Pat. Nos. 5,917,409, 6,166,633 and 6,157,299, seems to be the only solution today wherein the alarm system provides a verification condition to delay the activation of the control plane so as to reduce the false alarm possibility. The verification process is performed when one of the motion sensors detects a trigger motion within a respective motion detecting area, a motion signal is delayed for a preset time period as a single zone delaying period to send to the control panel. Therefore, the control panel is activated to normally respond by activating the local warning system to produce warning signals when the same motion sensor that detected the trigger motion detects another motion in the same motion detecting area within the single zone delaying period. Statistically, between year 2000 and 2002 when the alarm system incorporates with the verification process, the total false alarm reports were significantly reduced to 2% in comparison with the alarm system without the verification process.

However, since each building has its own interior structure, the single zone delaying period for each PIR sensor must be preset correspondingly. When the PIR sensor has a shorter single zone reacting period, the false alarm possibility will be reduced. However, the security protection of the alarm system will also be reduced.

In addition, when multiple zones are involved in the alarm system, another PIR sensor is preset as a cross zone reacting period. However, the time frame of the cross zone reacting period is an unknown to optimize both the false alarm reduction and the security protection.

The cross setting of the single zone and multiple zone raises a problem to the verification process. The conventional time zone setting for the multiple zone alarm system is that the cross zone reacting period is set as same as the single zone reacting period. However, it is not effective and generally fails to achieve the best performance.

SUMMARY OF THE PRESENT INVENTION

A main object of the present invention is to provide an alarm system with digital verification control, which optimizes both the false alarm reduction performance and the security protection performance.

Another object of the present invention is to provide an alarm system with digital verification control, which effectively reduces or even eliminate false alarms generated by motion type sensors, shock sensors, GBC and contacts, etc.

Another object of the present invention is to provide an alarm system with digital verification control, which is compatible with most alarm panel and sensors, wherein all the conventional alarm systems can be configured by the digital verification control to optimize both the false alarm reduction performance and the security protection performance.

Another object of the present invention is to provide an alarm system with digital verification control, wherein the time frames of the single zone verification time and the multiple zone verification time can be preset through the verification control process so as to minimize the false alarm possibility without reducing the security protection.

Another object of the present invention is to provide an alarm system with digital verification control, wherein the verification control process comprises a single zone verification analysis for analyzing the performance of the false alarm reduction and security protection with respect to the single zone verification time and a multiple zone verification analysis for analyzing the performance of the false alarm reduction and security protection with respect to the multiple zone verification time. Therefore, the optimum verification time is determined by the single zone verification time from the single zone verification analysis and the multiple zone verification time from the multiple zone verification analysis.

Another object of the present invention is to provide an alarm system with digital verification control, wherein the verification control process can substantially reduce the false alarm rate to as low as 0.5% in comparison with the alarm system without the verification control process.

Another object of the present invention is to provide an alarm system with digital verification control, wherein the verification control process fits for any alarm system installed into different structural designs of the building since both the single zone verification analysis and the multiple zone verification analysis must be performed to determine the optimum single zone verification time and the optimum multiple zone verification time.

Another object of the present invention is to provide an alarm system with digital verification control, wherein no expensive or complicated structure is required to employ in the present invention in order to achieve the above mentioned objects. Therefore, the present invention successfully provides an economic and efficient solution for enhancing not only the false alarm reduction performance but also the security protection performance.

Another object of the present invention is to provide an alarm system with digital verification control, which enhances approximately 100% immunity for unexpected false alarms, approximately 98% immunity for frequent false alarm, and greater than 95% immunity for worst case false alarms.

Accordingly, in order to accomplish the above objects, the present invention provides an alarm system with digital verification control, comprising a control panel, a local warning system electrically connected to the control panel, and two or more sensors which are respectively installed at a plurality of detecting areas and electrically connected to the control panel, wherein the digital verification control comprises first means for presetting a single zone verification time in the control panel and second mean for presetting a multiple zone verification time in the control panel.

The single zone verification time is a single sensor time delay for each of the sensors in such a manner that when one of the sensors detects at least two triggered signals in the respective detecting area within the single zone verification time, the control panel is activated to activate the local warning system for producing a local warning signal.

The multiple zone verification time, which is longer than the single zone verification time, is a multiple sensor time delay for the sensors in such a manner that when the two sensors detect two triggered signals in different detecting areas respectively within the multiple zone verification time, the control panel is activated to activate the local warning system for producing the local warning signal.

The present invention further comprises a process of a verification control for an alarm system which comprises a control panel, a local warning system electrically connected to the control panel, and two or more sensors which are respectively installed at a plurality of detecting areas and electrically connected to the control panel, wherein the process comprises the steps of:

(a) presetting a single zone verification time for each of the sensors in such a manner that when one of the sensors detects at least two triggered signals in the respective detecting area within the single zone verification time, the control panel is activated to activate the local warning system for producing a local warning signal; and (b) presetting a multiple zone verification time for the sensors wherein the multiple zone verification time is longer than the multiple zone verification time in such a manner that when two sensors detect two triggered signals in the detecting areas respectively within the multiple zone verification time, the control panel is activated to activate the local warning system for producing the local warning signal.

These and other objectives, features, and advantages of the present invention will become apparent from the following detailed description, the accompanying drawings, and the appended claims.

DETAILED DESCRIPTION OF THE PREFERRED EMBODIMENT

Figure 1:
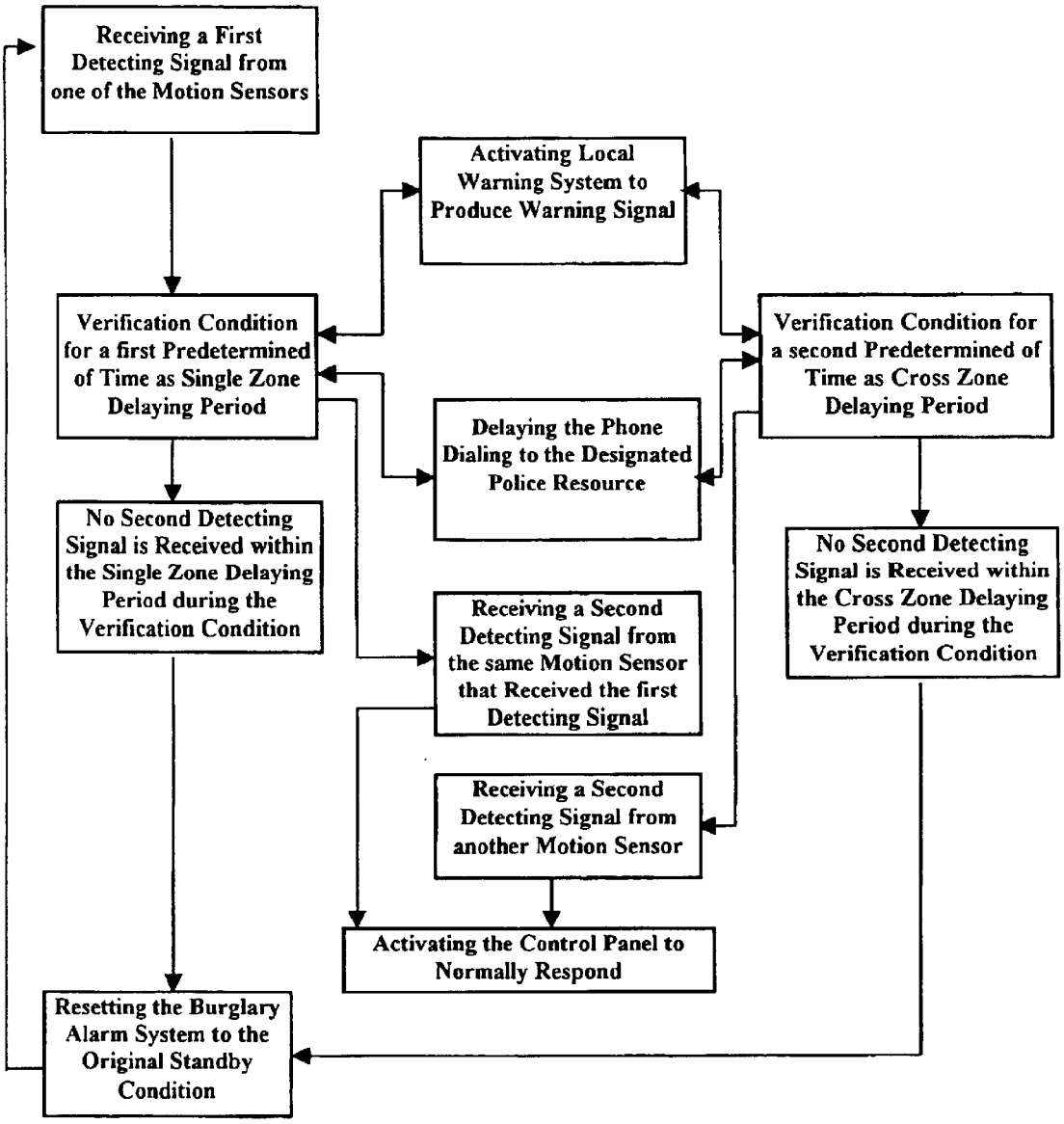
FIG. 1 is a block diagram of an alarm system according to a preferred embodiment of the present invention.

Referring to FIGS. 1 through 5 of the drawings, an alarm system incorporated with a digital verification control according to a preferred embodiment is illustrated, wherein the alarm system comprises a control panel, a local warning system electrically connected to the control panel, two or more sensors which are respectively installed at a plurality of detecting areas and electrically connected to the control panel, a dialing system being built in the control panel for transmitting signals to a central station for dispatching to a designated police resource when the dialing system is activated, as shown in FIG. 1.

The digital verification control comprises a first means for presetting a single zone verification time in the control panel and a second mean for presetting a multiple zone verification time in the control panel. Accordingly, the first and second means are timer devices, which can be built-in with the control panel, to delay the activation of the local warning system when the sensor firstly detects the triggered signal.

The digital verification control is mainly to configure a time frame for the alarm system to optimize both the false alarm reduction performance and the security protection performance, wherein a process of the digital verification control comprises the following steps.

(1) Preset the single zone verification time as a single sensor time delay for each of the sensors in such a manner that when one of the sensors detects at least two triggered signals in the respective detecting area within the single zone verification time, the control panel is activated to activate the local warning system for producing a local warning signal.

(2) Preset the multiple zone verification time as a multiple sensor time delay for the sensors wherein the multiple zone verification time must be longer than the multiple zone verification time in such a manner that when two sensors detect two triggered signals in the detecting areas respectively within the multiple zone verification time, the control panel is activated to activate the local warning system for producing the local warning signal.

Accordingly, the single zone verification time and the multiple zone verification time are preset in the control panel to configure the time frame of each of the sensors.

Figure 2:
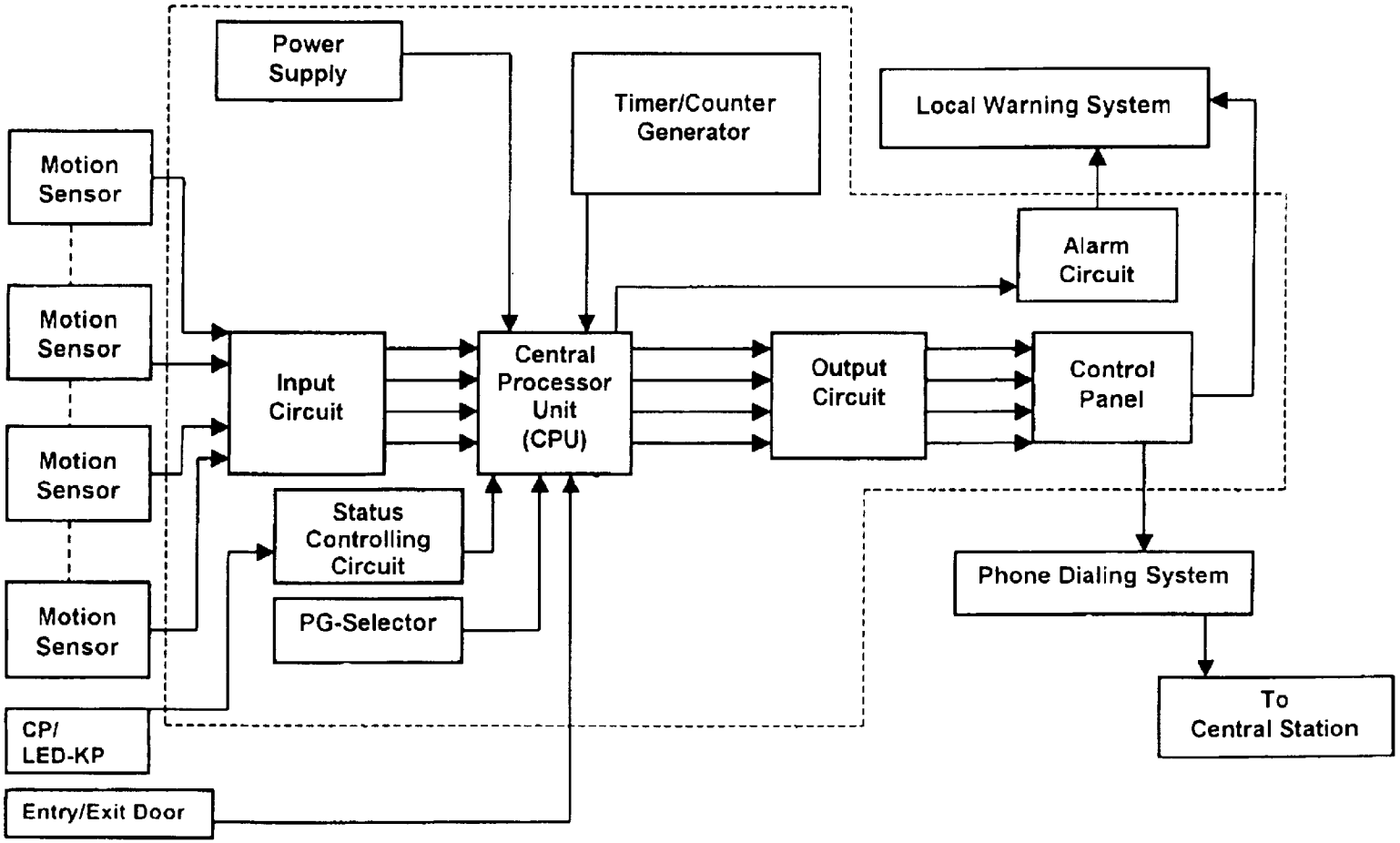
FIG. 2 is a block diagram of a process of reducing false alarm of the alarm system according to the above preferred embodiment of the present invention.

As shown in FIG. 2, the process for reducing false of the alarm system, which is activated by the alarm user by keying in the security code into an activating and de-activating keypad, comprises the steps as follows.

A. Activate the local warning system to produce a local warning signal for a designated period of time, normally two to five minutes, when any one of the motion sensors detects a triggered signal within the respective detecting area during a standby condition of the alarm system.

B. Delay to activate the control panel as well as the dialing system for a first preset time period as the single zone verification time and at least a second preset time period as the multiple zone verification time which is longer than the single zone verification time, wherein the alarm system is in a verification condition during the single zone and multiple zone verification times.

C. Activate the control panel to normally respond by activating the local warning system to produce warning signals and the dialing system to transmit digital signals to the central station when the same sensor that detected the triggered signal detects another signal in the same detecting area within the single zone verification time during the verification.

D. Activate the control panel to normally respond by activating the local warning system to produce warning signals and the phone dialing system to transmit digital signals to the central station when another sensor detects another signal in another detecting area within the multiple zone verification time during the verification condition.

E. Reset the alarm system to the original standby condition when there is no other signal is detected by any sensor during the verification condition, wherein the standby alarm system is ready to enter the verification condition again when there is signal detected by any of the sensors again.

Accordingly, each of the sensors of the alarm system, such as the PIR sensors and the motion sensors, is installed to provide a motion detecting area in such a manner that when one of the sensors detect a triggered motion as the signal, the alarm system is activated in the verification condition. It is worth to mention that other kinds of sensor can be used in the alarm system, such as shock sensors, GBD and contacts, and door/window sensors. In addition, different types of sensors can be used in the alarm system. For example, the door sensor is installed at the door entrance for detecting the signal of the door in an opened and closed manner while the motion sensor is installed at the living room for detecting the motion signal within the motion detecting area, wherein both the door sensor and the motion sensor are electrically connected to the control panel.

According to the preferred embodiment, the process of reducing the false alarm for the alarm system is incorporated with a verification control process to optimize the false alarm reduction performance and the security protection performance. The sensitivities of the single zone verification time and the multiple zone verification time with respect to the false alarm possibility and security protection for the alarm system are determined by a single zone verification analysis and a multiple zone verification analysis respectively.

Figure 5:
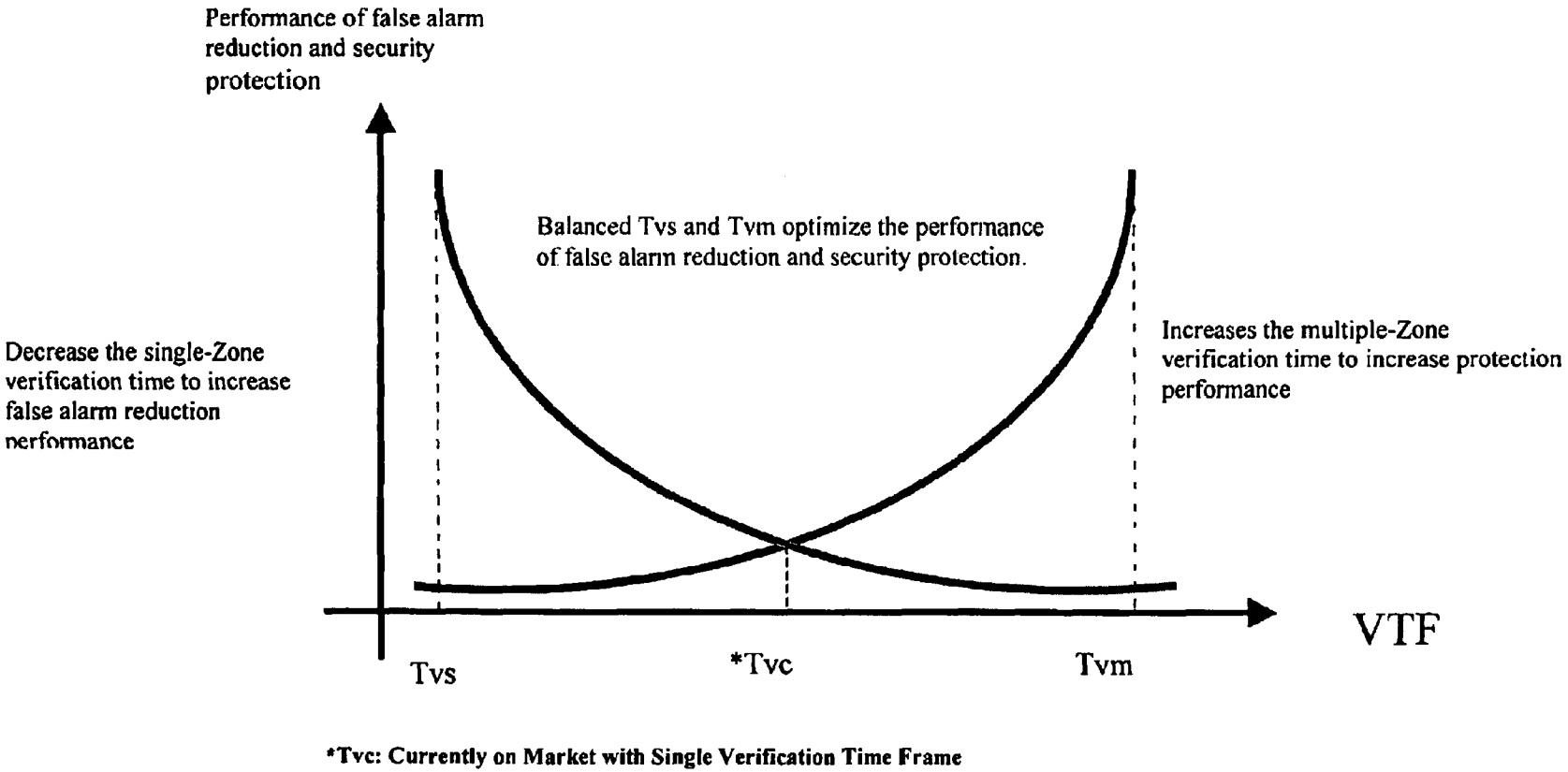
FIG. 5 is a graph of the digital verification control process for the alarm system according to the above preferred embodiment of the present invention, illustrating the combination of the single zone verification analysis and the multiple zone verification analysis.

As shown in FIG. 5, the single zone verification analysis is performed for analyzing a relationship between the single zone verification time and a performance of false alarm reduction and security protection, wherein a single zone verification curve is formed to indicate that when the single zone verification time is increased, the performance of false alarm reduction and security protection reduced. In other words, while decreasing the single zone verification time, the false alarm reduction performance will be increased.

In addition, the multiple zone verification analysis is performed for analyzing a relationship between the multiple zone verification time and the performance of false alarm reduction and security protection, wherein a multiple zone verification curve is formed to indicate that when a multiple zone verification time is increased, the performance of false alarm reduction and security protection increased.

As it is mentioned in the background, the single zone verification time, which is the same as the multiple zone verification time, for the conventional alarm system is determined by combining the single zone verification analysis and the multiple zone verification analysis, wherein the conventional verification time is preset at an intersection of the single zone verification curve and the multiple zone verification curve.

Figure 3:
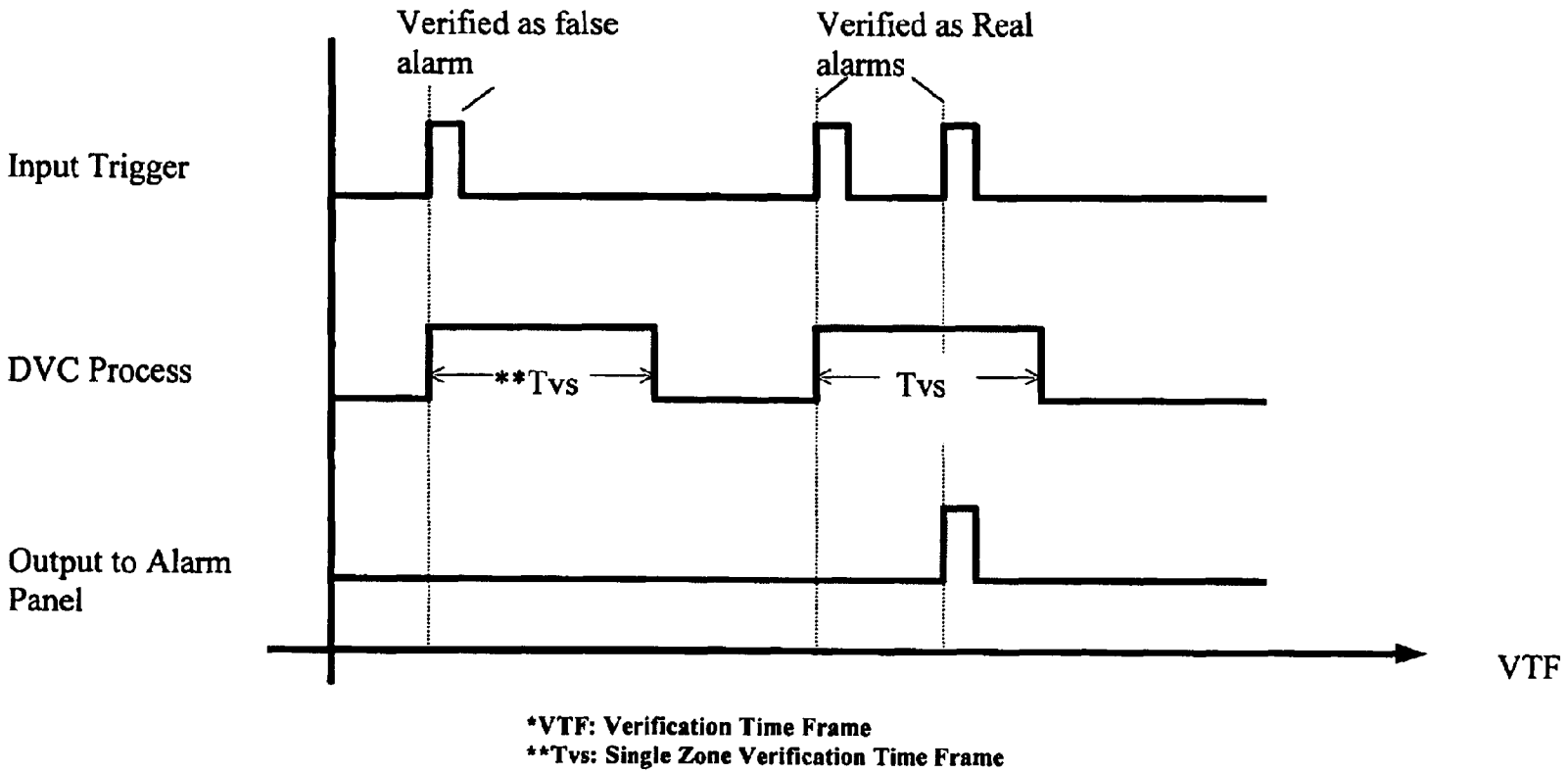
FIG. 3 is a graph of a single zone verification analysis of a digital verification control process for the alarm system according to the above preferred embodiment of the present invention.

According to the preferred embodiment, the single zone verification analysis is performed to verify the single zone verification time so as to reduce the false alarm possibility of the alarm system. As shown in FIG. 3, when the triggered signal is first received by one of the sensors within the detecting area, the single zone verification is started while the alarm system is in the verification condition. If there is no other signal is detected by the same sensor within the single zone verification time, the alarm system is reset back to the standby condition so that no local warming signal and no digital signal is transmitted to the central station. In other words, the first trigger is verified as a false alarm.

When another signal is detected by the same sensor within the single verification time, the local warning system is activated to produce warning signals and the dialing system is activated to transmit digital signals to the central station.

The single zone verification analysis mainly verifies the single verification time with respect to the false alarm possibility. When the single zone verification time is lengthened to reduce the false alarm possibility, the security protection of the alarm system will be decreased. Therefore, by varying the single zone verification time, the single zone verification curve is plotted to indicate the relationship between the single zone verification time and the performance of false alarm reduction and security protection, as shown in FIG. 5.

After finishing the single zone verification analysis, the multiple zone verification analysis should be performed to verify the multiple zone verification time so as to reduce the false alarm possibility of the alarm system.

The optimum single zone verification time, which is based on the single zone verification analysis, is determined by taking derivative with respect to time. As shown in FIG. 5, the single zone verification time should preset at a range from 5 to 15 seconds to obtain optimum the false alarm reduction performance. Accordingly, the optimum single zone verification time is preferred to be preset at 10 seconds.

The optimum multiple zone verification time, which must be longer than the single zone verification time, is determined based on the multiple zone verification analysis by taking derivative with respect to time. As shown in FIG. 5, the multiple zone verification time is preset less than 1–3 minutes to obtain the optimum security protection performance. Accordingly, the optimum multiple zone verification time is preferred to be preset at 2 minutes.

Figure 4:
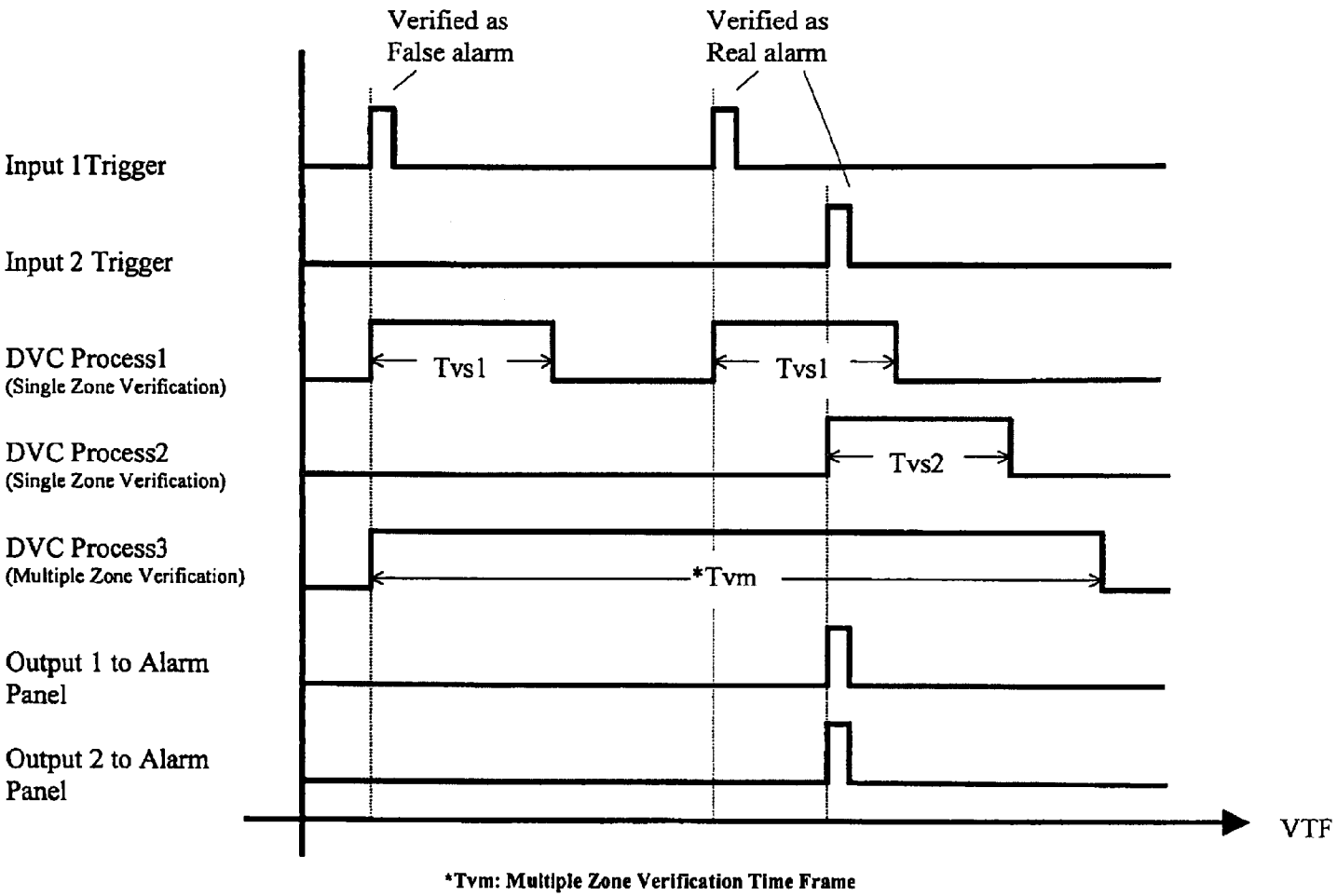
FIG. 4 is a graph of a multiple zone verification analysis of the digital verification control process for the alarm system according to the above preferred embodiment of the present invention.

As shown in FIG. 4, when the triggered signal is first received by one of the sensors within the detecting area, both the single zone verification and the multiple zone verification are started at the same time while the alarm system is in the verification condition. If there is no second signal is detected either by the same sensor within the single zone verification time or by another sensor within the multiple zone verification time, the alarm system is reset back to the standby condition, so that no local warming signal and no digital signal is transmitted to the central station. Therefore, there is a false alarm.

When another sensor detects the second signal within the respective detecting area within the multiple zone verification area, the local warning system is activated to produce warning signals and/or the dialing system is activated to transmit digital signals to the central station. It is worth to mention that when the second sensor detects the second signal, the single zone verification time of the second sensor will be simultaneously started. Therefore, the multiple zone verification time must be set longer than the single zone verification time.

The multiple zone verification analysis mainly verifies the multiple verification time with respect to the false alarm possibility. When the multiple zone verification time is lengthened to reduce the false alarm possibility, the security protection of the alarm system will be increased. Therefore, by varying the multiple zone verification time, the multiple zone verification curve is plotted to indicate the relationship between the multiple zone verification time and the performance of false alarm reduction and security protection, as shown in FIG. 5.

As a result, the single zone verification curve and the multiple zone verification curve are formed after performing the single zone verification analysis and the multiple zone verification analysis respectively. Since both the single zone verification curve and the multiple zone verification curve are related to the performance of false alarm reduction and security protection with respect to the time frame. Therefore, the results of the single zone verification analysis and the multiple zone verification analysis can be combined to overlap the single zone verification curve and the multiple zone verification curve in accordance with the performance of false alarm reduction and security protection and the time frame, as shown in FIG. 5. It is worth to mention that the results of the single zone verification analysis and the multiple zone verification analysis are sent to the central station such that the experienced alarm consultant at the central station is able to analysis the optimum verification times, i.e. the optimum single zone verification time and the optimum multiple zone verification time, so as to minimize any computerized error during calculation.

It is worth to mention that since the single zone verification time is determined by the single zone verification curve through the single zone verification analysis and the multiple zone verification time is determined by the multiple zone verification curve through the multiple zone verification analysis, the single zone verification time and the multiple zone verification time are capable of presetting at any conventional alarm system as a time configuration thereof to maximize the performance of false alarm reduction and security protection of the alarm system Accordingly, the verification control process is effective in all types of false alarms:

| Type of False Alarm | Percent | False Alarm Reduction Rate |
|---|---|---|
| Generated Fortuitously | 30% | 100% |
| Generated with Certain Patterns | 60% | 98% |
| Bad Environment, e.g. outdoor applications | 10% | 95% |

Before activating the local warning system to produce warning signals and dialing system to transmit digital signal to the central station, the alarm system may further comprise a video system connected to a digital video output of the control panel. Therefore, the process for reducing false of the alarm system further comprises the steps as follows.

(1) Activate the digital cameras or video cameras of the video system to record and transmit the real-time scene to the central station for a designated period of time for monitoring and verifying whether there is any burglar within the detecting areas.

(2) Activate the control panel to normally respond by activating the local warning system to produce warning signals and the dialing system to transmit digital signals to the central station to call police when a burglar is found in the detecting areas via the video system.

(3) Reset the alarm system to the original standby condition when there is no burglar found in the detecting areas via the video system.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. An alarm system, comprising a control panel;

a local warning system electrically connected to said control panel;

at least two sensors which are respectively installed at a plurality of detecting areas and electrically connected to said control panel; and a digital verification control, comprising:

first means for verifying a single zone verification time in said control panel, wherein said single zone verification time is a single senor time del to delay an activation of said local warning system while one of said sensors is trigger; and second means for verifying a multiple zone verification time in said control panel corresponding to a distance between each two sensors at two different detecting areas, wherein said multiple zone verification time is a multiple senor time delay to delay said activation of said local warning system while said two sensors at two different detecting areas are triggered, wherein said multiple zone verification time is longer than said single zone verification time;

thereby, when one of said sensors detects at least two triggered signals in said respective detecting area within said single zone verification time, said control panel is activated to activate said local warning system for producing a local warning signal and when two sensors detect two triggered signals in said detecting areas respectively within said multiple zone verification time, said control panel is activated to activate said local warning system for producing said local warning signal.

2. The alarm system, as recited in claim 1, wherein said first means and said second means are timer devices respectively to delay said activation of said local warning system when one of said sensors is firstly triggered.

3. The alarm system, as recited in claim 1, wherein said single zone verification time is preset with a range from 5 to 15 seconds.

4. The alarm system, as recited in claim 2, wherein said single zone verification time is preset with a range from 5 to 15 seconds.

5. The alarm system, as recited in claim 1 wherein said multiple zone verification time is preset less than 2 minutes.

6. The alarm system, as recited in claim 2, wherein said multiple zone verification time is preset less than 2 minutes.

7. The alarm system, as recited in claim 3, wherein said multiple zone verification time is preset less than 2 minutes.

8. The alarm system, as recited in claim 4, wherein said multiple zone verification time is preset less than 2 minutes.

9. The alarm system, as recited in claim 1, wherein said single zone verification time is preset at 10 seconds.

10. The alarm system, as recited in claim 2, wherein said single zone verification time is preset at 10 seconds.

11. The alarm system, as recited in claim 1, wherein said multiple zone verification time is preset at 2 minutes.

12. The alarm system, as recited in claim 2, wherein said multiple zone verification time is preset at 2 minutes.

13. The alarm system, as recited in claim 9, wherein said multiple zone verification time is preset at 2 minutes.

14. The alarm system, as recited in claim 10, wherein said multiple zone verification time is preset at 2 minutes.

15. A process of a verification control for an alarm system which comprises a control panel, a local warning system electrically connected to said control panel, and at least two sensors which are respectively installed at a plurality of detecting areas and electrically connected to said control panel, comprising the steps of:

(a) verifying a single zone verification time for each of said sensors in such a manner that when one of said sensors detects at least two triggered signals in said respective detecting area within said single zone verification time, said control panel is activated to activate said local warning system for producing a local warning signal; and (b) verifying a multiple zone verification time for said sensors corresponding to a distance between each two said sensors at different detecting areas wherein said multiple zone verification time must be longer than said single zone verification time in such a manner that when said two sensors detect two triggered signals in said detecting areas respectively within said multiple zone verification time, said control panel is activated to activate said local warning system for producing said local warning signal.

16. The process, as recited in claim 15, wherein said single zone verification time is preset with a range from 5 to 15 seconds.

17. The process, as recited in claim 15, wherein said multiple zone verification time is preset less than 2 minutes.

18. The process, as recited in claim 16, wherein said multiple zone verification time is preset less than 2 minutes.

19. The process, as recited in claim 15, wherein said single zone verification time is preset at 10 seconds.

20. The alarm system, as recited in claim 15, wherein said multiple zone verification time is preset at 2 minutes.

21. The alarm system, as recited in claim 19, wherein said multiple zone verification time is preset at 2 minutes.

* * * * *